United States Patent [19]

Bentivoglio

[11] Patent Number: 4,889,038

[45] Date of Patent: Dec. 26, 1989

[54] HYDRAULIC CYLINDER

[75] Inventor: Giovanni Bentivoglio, Woodbridge, Canada

[73] Assignee: Tovel Manufacturing Limited, Concord, Canada

[21] Appl. No.: 220,805

[22] Filed: Jul. 18, 1988

[51] Int. Cl.[4] ..... F01B 31/00; B66B 9/20

[52] U.S. Cl. ..... 92/110; 92/137; 92/146; 92/161; 91/170 R; 187/9 E; 187/9 R

[58] Field of Search ..... 92/51, 52, 53, 107, 92/108, 110, 111, 112, 146, 161, 151, 162 R, 163, 137; 91/169, 181, 170, 174, 178, 183, 184, 189 R, 189 A, 192, 193, 511, 517, 513, 536; 187/9 E, 9 R

[56] References Cited

U.S. PATENT DOCUMENTS

| | | | |
|---|---|---|---|
| 3,534,664 | 3/1969 | Ulinski | 187/9 E |
| 4,294,572 | 10/1981 | Pattison | 92/52 |
| 4,592,449 | 6/1986 | Sakata et al. | 187/9 E |

FOREIGN PATENT DOCUMENTS

| | | | |
|---|---|---|---|
| 8103014 | 10/1981 | European Pat. Off. | 187/9 E |
| 1063969 | 8/1957 | Fed. Rep. of Germany | 187/9 E |
| 1431497 | 12/1968 | Fed. Rep. of Germany | 187/9 E |
| 0049404 | 5/1981 | Japan | 91/189 R |
| 0184303 | 10/1983 | Japan | 91/189 R |
| 88803 | 3/1937 | Sweden | 91/169 |

*Primary Examiner*—Margaret A. Focarino
*Assistant Examiner*—Thomas Denion
*Attorney, Agent, or Firm*—Ivor M. Hughes

[57] ABSTRACT

A hydraulic cylinder comprising a hollow sleeve, having inserted in it, a hollow piston rod. The hollow sleeve further contains an opening allowing hydraulic fluid to pass therethrough and into the hollow piston rod. At the end remote to the opening, a mounting mechanism is contained. On the end proximate the mounting mechanism, a fluid outlet is contained. In use, hydraulic fluid passes through the opening of the hollow sleeve, into the piston rod, and out of the piston rod proximate the mounting mechanism.

14 Claims, 6 Drawing Sheets

HYDRAULIC CYLINDER

FIELD OF INVENTION

This invention relates to the construction of hydraulic fluid actuated cylinders and specifically to those found within material handling trucks.

BACKGROUND OF THE INVENTION

One of the main concerns that a fork truck operator has is the visibility available to him when operating his fork truck in the direction of the forks extension. Another concern of owners of fork truck mechanisms is the cost of replacement and repair of hydraulic hoses. The conventional fork truck having multiple stage lifting mechanisms to lift loads beyond approximately 8 feet as are well known in the art, have a considerable number of hoses extending from a hydraulic reservoir or pump to each and every individual cylinder requiring hydraulic fluid. By extending the hose the distance between the reservoir and the respective hydraulic cylinders and further by allowing the hose to extend through at least two passes to allow for movement of the stages of the carriage mechanism, a considerable amount of hose is required. The hydraulic hose normally passes from the cylinder over a pulley down to another pulley up to another pulley and then down finally to the reservoir as an example. This hose coupled with the chain conventionally found in driving multiple stage lifting mechanisms tends to block the operators view in between the carriages and creates a maintenance problem for the operator of the fork truck.

Canadian Pat. No. 1,097,266 addresses such a problem wherein the hose extends from one cylinder around the carriage to the other free lift cylinder wherein the hose will not block the view of the operator, however, there still remains the problem of maintaining the hose. Such a construction as embodied in FIG. 12 of the Canadian Pat. No. 1,097,266 describes the known construction to convey fluid from one cylinder to another cylinder.

U.S. Pat. No. 4,018,307 describes a tri-pack of cylinders which are mechanically and hydraulically interconnected wherein the hydraulic fluid admitted to the interior of a secondary cylinder passes through a hydraulic interconnection between the cylinders to a pair of continuously disposed primary cylinders. This is best illustrated in relation to FIGS. 3 and 6. Thus, a fitting illustrated in FIG. 7 of the 4,018,307 patent is provided to allow for the interconnection of the cylinders, but the cylinders are constructed in conventional manner. There is no outlet from the top of the cylinder to allow fluid to pass through the hollow of the piston and be used as not only a driving means but as well as a fluid conducting means.

Canadian Pat. No. 1,174,205 describes a cylinder used in a multiple stage assembly having two piston rods extending away from one another in use as described in relation to FIG. 5. Again, the fluid does not pass through the piston rod and the piston does not behave as a conducting channel for hydraulic fluid.

Canadian Pat. No. 1,220,404 describes and as illustrated in FIG. 1 a double acting cylinder which is not hollow but merely acts in both directions according to the pressure differentials of fluid flow. This device corresponds to U.S. Pat. No. 4,561,342 and is used as a leveling device for the bucket of a tractor type mechanism.

Soviet Union Publication 645930 describes two-way telescopic power cylinder having a hollow rod with channels therein as illustrated in the figure, but having no passage of fluid outside of this cylinder. The fluid will flow through the inlet 9 through to the hollow piston rod 19 and then to a pressure balancing chamber disposed within the assembly. Nowhere within the structure is described the passage of the fluid as best understood by Applicant outside the cylinder. Further, Soviet Union Pat. No. 1158408 describes a hollow piston rod disposed within a cylinder used to transport fluid to all of the nested cylinders within a dump truck mechanism. The dump truck includes a telescoping cylinder which has various number of stages wherein the fluid will pass to all the stages through the hollow piston rod. However, the fluid does not pass outside of the cylinder as not used as conducting means to provide fluid to another cylinder.

Nowhere within the prior art is there found a cylinder used in a material handling truck which has a hollow passage extending therethrough and has inlet and outlet ports to allow the fluid to enter and exit the cylinder wherein the cylinder acts as a normal cylinder in use and further acts as a fluid conducting mechanism.

It is therefore an object of the invention to provide a cylinder constructed for use in a material handling truck, wherein the cylinder behaves as a conventional cylinder but allows for fluid to pass therethrough to locations remote the cylinder.

It is a further object of the invention to reduce the maintenance cost of hoses found in material handling trucks.

Further and other objects of the invention will become apparent to a man skilled in the art when considering the following summary of the invention and the more detail description of the preferred embodiments illustrated herein.

SUMMARY OF THE INVENTION

To these ends according to one aspect of the invention there is provided a hydraulic cylinder comprising a hollow tubular sleeve having inserted there within in use a hollow piston rod, said hollow sleeve having disposed therein at one end thereof an inlet for hydraulic fluid and being otherwise substantially closed at that end, said hollow cylinder having inserted therein the hollow piston rod in use, said hollow piston rod in use having disposed at the end of the piston rod proximate the closed end of the cylinder an opening allowing hydraulic fluid to pass from the inlet into the hollow piston rod, the hollow piston rod being otherwise substantially open at the end of the opening across at least a portion of the diameter of the piston rod at the end of the opening, said hollow piston rod having disposed at the end of the hollow piston rod remote the opening therein mounting means, the hollow piston rod having at the end proximate the mounting means an outlet, preferably the hollow cylinder being sealed at the end of the cylinder proximate the mounting means on the hollow piston rod, preferably the cylinder assembly having at the end thereof proximate the mounting means sealing means to seal the piston rod against the hollow sleeve; whereby in use hydraulic fluid passes through the inlet of the hollow sleeve into the piston rod at the end proximate the inlet to the hollow sleeve and then out of the piston rod proximate the mounting means of the piston rod at the end of the piston remote the hydraulic oil inlet.

According to yet another aspect of the invention for use in a material handling truck there is provided a hydraulic cylinder comprising a hollow tubular sleeve having inserted there within in use a hollow piston rod, said hollow sleeve having disposed therein at one end thereof an inlet for hydraulic fluid and being otherwise substantially closed at that end, said hollow cylinder having inserted therein the hollow piston rod in use, said hollow piston rod in use having disposed at the end of the piston rod proximate the closed end of the cylinder an opening allowing hydraulic fluid to pass from the inlet into the hollow piston rod, the hollow piston rod being otherwise substantially open at the end of the opening across at least a portion of the diameter of the piston rod at the end of the opening, said hollow piston rod having disposed at the end of the hollow piston rod remote the opening therein mounting means, the hollow piston rod having at the end proximate the mounting means an outlet, preferably the hollow cylinder being sealed at the end of the cylinder proximate the mounting means on the hollow piston rod, preferably the cylinder assembly having at the end thereof proximate the mounting means sealing means to seal the piston rod against the hollow sleeve; whereby in use hydraulic fluid passes through the inlet of the hollow sleeve into the piston rod at the end proximate the inlet to the hollow sleeve and then out of the piston rod proximate the mounting means of the piston rod at the end of the piston rod remote the hydraulic oil inlet.

According to yet another aspect of the invention for use in a material handling truck having a hydraulic system there is provided a mast assembly comprising a first cylinder having a preferably radial inlet at one end, and at least a second cylinder, said first cylinder having a first piston rod disposed therein, at least one of said at least a second cylinder having a hollow piston rod disposed therein, said first piston rod being of a greater diameter than said hollow piston rod, said hollow piston rod having two ends and having a hollow chamber extending axially through the center thereof, at least one hollow piston rod having an opening disposed at one end of the hollow piston rod proximate the preferably radial inlet of said first cylinder and in communication with said hollow chamber, said at least one hollow piston rod being otherwise substantially open at the end of the opening across at least a portion of the diameter of the piston rod at the end of the opening, said hollow piston rod having mounting means disposed at the end thereof remote said opening, having proximate said end of said mounting means an opening extending therethrough from said mounting means or said piston rod at the end in communication with said hollow chamber, said at least a second cylinder initially receiving hydraulic fluid from said hydraulic system, said hydraulic fluid passing through the hollow chamber of said hollow piston rod of said at least a second cylinder, said hydraulic fluid exiting said hollow piston rod proximate said mounting means and being conducted to said first cylinder; whereby the piston rod in said first cylinder will extend to a predetermined extent when hydraulic fluid enters therein, whereby following the extension of said first piston rod to a predetermined extent said hollow piston rod of said at least a second hydraulic cylinder will extend up to its predetermined extent.

According to another aspect of the invention for use in a fork truck having a hydraulic system there is provided a mast assembly comprising a first cylinder having a preferably radial inlet at one end and at least a second cylinder, said first cylinder having a first piston rod disposed therein, at least one of said at least a second cylinder having a hollow piston rod disposed therein, said first piston rod being of a greater diameter then said hollow piston rod, said hollow piston rod having two ends and having a hollow chamber extending axially through the center thereof, at least one hollow piston rod having an opening disposed at one end of the hollow piston rod, proximate the prferably radial inlet of said first cylinder and in communication with said hollow chamber, said at least one hollow piston rod being otherwise substantially open at the end of the opening across at least a portion of the diameter of the piston rod at the end of the opening, said hollow piston rod having mounting means disposed at the end thereof remote said opening, having proximate said end of said mounting means an opening extending therethrough from said mounting means or said piston rod at that end in communication with said hollow chamber, said at least a second cylinder initially receiving hydraulic fluid from said hydraulic system, said hydraulic fluid passing through the hollow chamber of said hollow piston rod of said at least a second cylinder, said hydraulic fluid exiting said hollow piston rod proximate said mounting means and being conducted to said first cylinder; whereby the piston rod in said first cylinder will extend to a predetermined extent when hydraulic fluid enters therein, whereby following the extension of said first piston rod said hollow piston rod of said at least a second hydraulic cylinder will extend up to its predetermined extent.

According to yet another aspect of the invention, there is provided for use in a material handling fork truck a mast assembly comprising a first cylinder for free lifting of a pair of forks of the material handling truck and at least a second cylinder used for lifting subsequent stages of said material handling fork truck; said at least a second cylinder having an inlet and an outlet one proximate each end of said cylinder, said at least a second cylinder having disposed therein a hollow piston rod extending therethrough through which hydraulic fluid passes, the hollow piston rod having a second inlet in communication with the inlet of the at least a second cylinder and an outlet, the first cylinder being of greater diameter than the at least a second cylinder and having conduit means to conduct the fluid from the outlet of the piston rod of the at least a second cylinder to the inlet of the first cylinder whereby fluid passes through the at least a second cylinder through the hollow piston rod thereof passing through the inlet of the cylinder through the second inlet of the hollow piston rod through the outlet of the hollow piston rod to said first cylinder and raises said first cylinder to a predetermined extent and subsequently causes the at least a second cylinder to extend its predetermined extent.

According to yet another aspect of the invention there is provided a fork truck carriage assembly comprising four stage sections, said first section being attached to a main frame of the fork truck, said second stage being attached to at least one cylinder, said at least one cylinder being further attached to said first stage, the third stage being in communication with said first stage and being linked thereto by first engaging means, having a fourth stage in communication with said second stage and linked thereto by second engagement means, said fourth stage having attached thereto a first drive cylinder extending substantially vertically and having an inlet for hydraulic fluid to allow free lift of the forks of the fork truck to the full extent of the predetermined limit of extension of the first cylinder, said first stage having attached thereto the at least one and preferably two secondary cylinders extending substantially vertically to allow lifting of the second stage to the predetermined limit of the at least one and preferably two secondary cylinders, the at least one and preferably two secondary cylinders being of less diameter than said first cylinder, and having an inlet disposed at one end thereof, at least one of said at least one secondary cylinders including a hollow piston rod through which hydraulic fluid passes from top to bottom thereof, the hollow piston rod having a second inlet in communication with the inlet of said second cylinder and an outlet for the hydraulic fluid to pass through the hollow piston rod to the outlet thereof and transmitted therefrom by fluid conducting means to the inlet of said first drive cylinder, fluid therefore passing to the first drive cylinder until it is extended to a predetermined extent wherein the at least one secondary cylinder will extend to its predetermined level, said third stage being extended by first engagement means linking said third stage with said first stage around pulley means attached to said second stage whereby the first engagement means causes the third stage to raise in cooperation with said second stage, said fourth being extended by second engagement means attached at one end to said second stage and passing over pulley means disposed on said third stage being fastened to said fourth stage at the other end of said engagement means wherein movement of said second stage allows for the cooperative movement of said fourth stage, said hydraulic fluid conducting means being connected only from said at least one secondary cylinder to said primary cylinder whereby all the stages will extend to a maximum of the full extent allowed by the movement of the secondary cylinder in cooperative movement therefor with said first and second engagement means.

According to yet another aspect of the invention the hollow piston rod may further comprise mounting means being lug means.

DETAILED DESCRIPTION OF THE PREFERRED EMBODIMENTS

Figure 1:
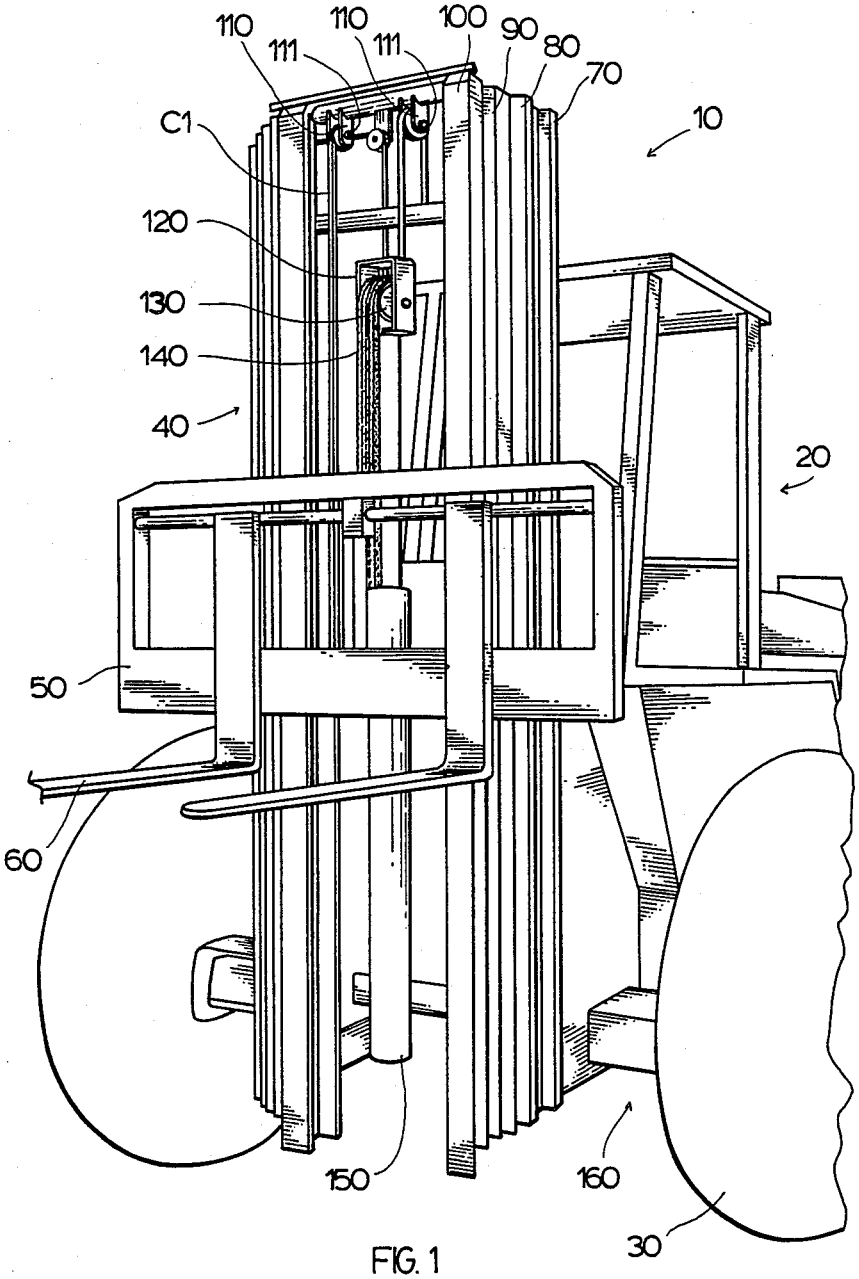
FIG. 1 is a perspective view of a material handling truck incorporating a four stage mast in a preferred embodiment of the invention.

Referring now to FIG. 1, there is illustrated a material handling truck 10 mounted upon wheels 30 having a frame 160 upon which the material handling truck is built. An operator upper frame 20 is provided for the protection of the operator. At the front of the material handling truck is situated a carriage mechanism 40 being a four stage carriage mechanism for enabling the fork carrying frame 50 carrying forks 60 to move vertically when loaded to the full extent of the extension of the carriage mechanism. Carriage mechanisms are well known in the art as described in the background of the invention. The movement of the carriage mechanism 40 is most clearly observed in relation to FIG. 8 and 9, wherein the four stages of the preferred embodiment are illustrated having a centrally disposed free lift cylinder 150 disposed as illustrated in FIG. 1 for the purposes of movement of the framing member 50 wherein the forks 60 are located. Subsequent to the full extension of the free lift cylinder 150 the stages 100, 90, 80 and 70 will begin to rise through the motivation of two secondary cylinders not illustrated in FIG. 1 but most clearly observed in relation to FIG. 2. The free lift cylinder 150 has associated therewith a multiple pulley and pulley frame 130 and 120 respectively over which extends a hose section 140 which extends downwardly to an inlet port I2 as most clearly observed in relation to FIG. 2 and FIG. 3. A chain C1 extends over pulleys 110 and their respective mountings 111 as is known in conventional methods. The material handling truck 10 is constructed as those normally found in the art and the preferred embodiment will now deal with specifically the carriage 40 within the material handling truck and the four stage lift mechanism wherein a minimum number of hoses and fittings related thereto are used in order to accomplish the task of the carriage and that is to lift a load supported by the forks 60 a distance of 30 feet vertically in the preferred embodiment.

Figure 2:
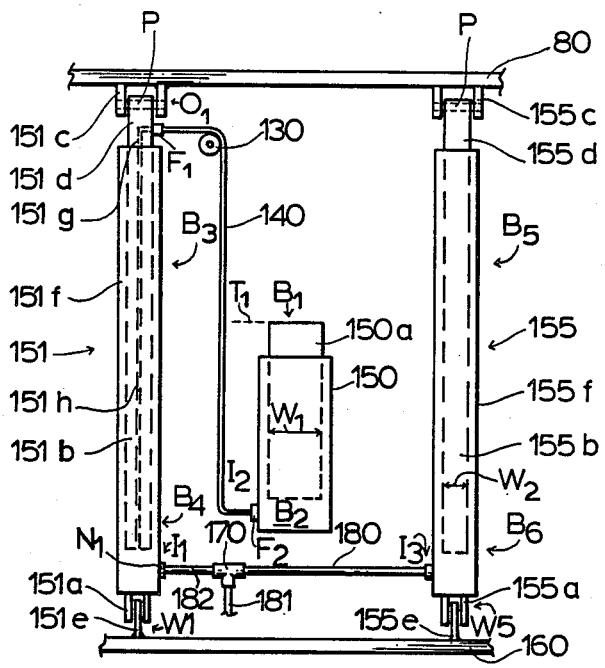
FIG. 2 is a schematic view of the lifting cylinders incorporated in the carriage mechanism of the material handling truck of FIG. 1.
Figure 3:
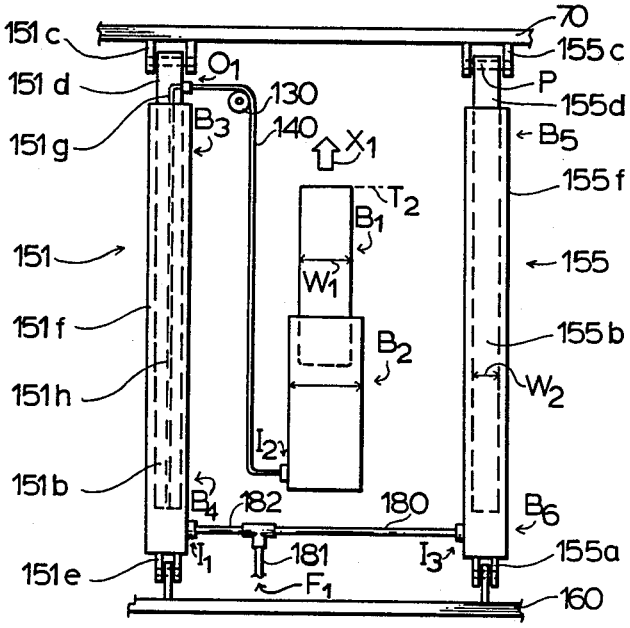
FIG. 3 is a view similar to FIG. 2 illustrating an alternative position for one of the cylinders of the carriage mechanism in the preferred embodiment of the invention.
Figure 4:
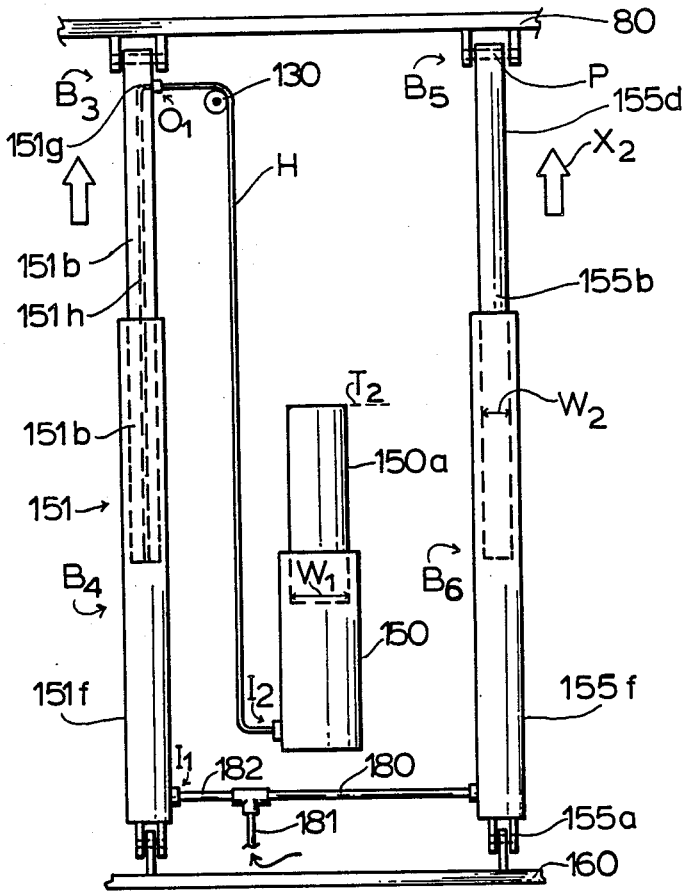
FIG. 4 is a view of the extension of the secondary cylinders after the primary free lift cylinder has extended to its full extent in a preferred embodiment of the invention.
Figure 8:
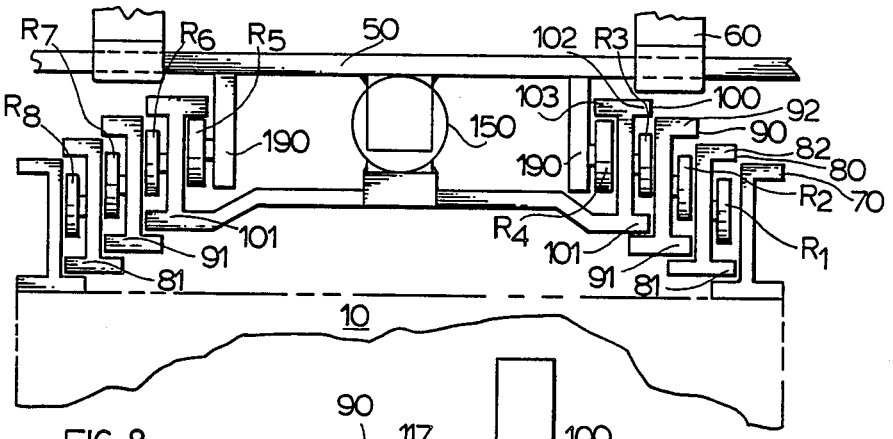
FIG. 8 is a top view of the carriage mechanism of the material handling truck of FIG. 1 illustrating the interrelationships of the each stage of a carriage mechanism in a preferred embodiment of the invention.
Figure 9:
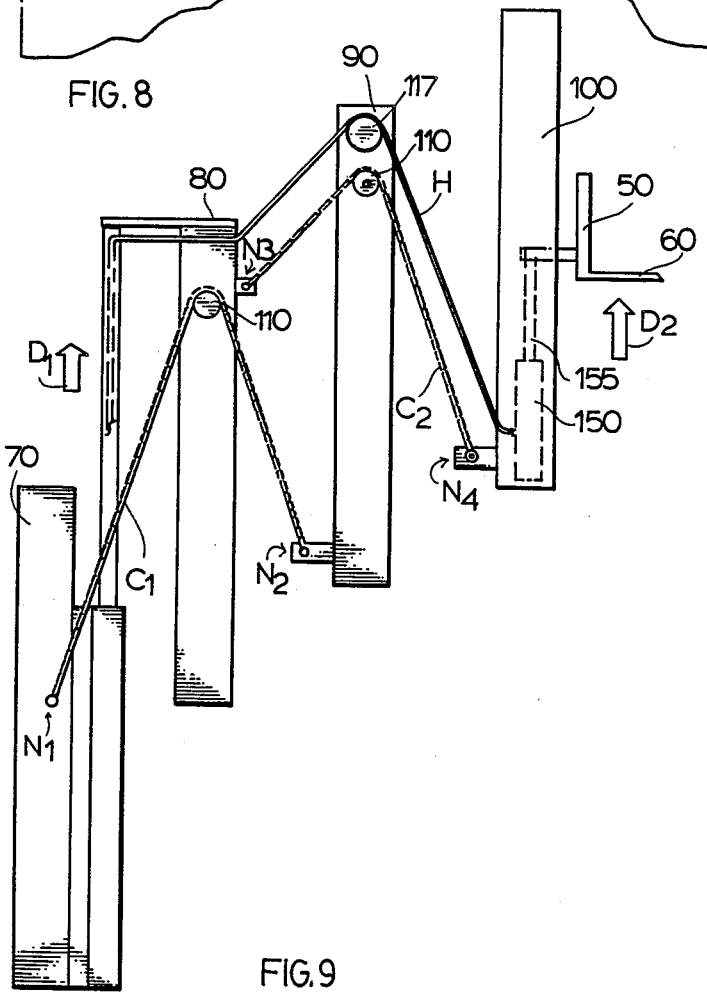
FIG. 9 is a schematic view similar to FIG. 7 illustrating the extension of the four stage carriage mechanism in a preferred embodiment of the invention.

Referring now to FIGS. 2, 3, and 4 therein is illustrated schematically hydraulic cylinders 150, 151 and 155 used in moving the four stages of the carriage mechanism 40 as best illustrated in relation to FIGS. 8 and 9. Therefore, there is disposed a free lift cylinder 150 having a greater internal diameter W1 than either cylinders 151 or 155 which have identical internal diameters W2. Disposed within the free lift cylinder 150 is a piston rod 150*a* having an end B1 and another end B2 located proximate an inlet I2 for hydraulic fluid. The piston rod 150*a* is located in a vertical position T1 prior to the beginning of its stroke. The secondary cylinders 151 and 155 are attached to the main frame 160 at joints W1 and W5 comprising mounting lugs 151*a* and 155*a* for each cylinder 151 and 155 and a mounting support 151*e* and 155*e* extending from the frame 160. At the upper end of each secondary cylinder there is located carriage stage 80 to which both secondary cylinders 151 and 155 are fastened by pins P at lugs 151*d* and 155*d* respectively. Mating portions 151*c* and 155*c* extend from the carriage frame stage 80 and are thereat connected to each of the secondary cylinders 151 and 155 by pins P.

Cylinders 151 and 155 are identical in diameter and in stroke with the exception that the internal mechanism within cylinder 151 are substantially different than those disposed within cylinder 155, therefore cylinder 155 being a standard cylinder has a piston rod **155*b* disposed therein of a diameter W2 and is attached to the frame 160 at one end and to the carriage stage 80 at the other end. A hydraulic oil inlet I3 is disposed on the outer circumference of the cylinder on the side of the cylinder proximate the free lift cylinder 150**. The cylinder will operate by conventional methods.

Referring now to cylinder 151, there is disposed a outer cylinder portion **151*f* similar to 155*f* of cylinder 155 having an inner diameter and an outer diameter, the inner diameter being W2. Disposed within the inner diameter of the cylinder is located a hollow piston rod 151*b*, the hollow piston rod having an internal channel 151*h* extending from one end proximate the inlet I1 to the other end proximate the outlet O1. The inlet I1 allows hydraulic fluid to pass from the main line 181 through the "T" 170 into the hollow cylinder 151*f* into the interior of the piston rod 151*b* through the channel 151*h* wherein the fluid will pass through the hollow and out through the channel 151*g* disposed within the mounting lug 151*d* wherein the hydraulic fluid will pass out through the outlet O1 through the hose 140, the hydraulic fluid then passing to the inlet I2 of the free lift cylinder 150**.

If a cylinder has a greater diameter than a second cylinder in series therewith the hydraulic fluid will act upon it first. Thus, we find in our circuit of the instant invention that the cylinder **150*a* of the free lift cylinder 150 has a diameter W1 which is greater than the diameter W2 of the two secondary cylinders. When a hydraulic fluid is pumped through inlet I1 it will initially pass through and fill the hollow piston rod 151*b* through and filling channel 151*h* until the hydraulic fluid passes through the channel 151*g* disposed through the mounting lug 151*d* and extends outwardly away from the cylinder 151 toward cylinder 155 at outlet O1 wherein a fitting is provided F1 upon the hose 140 which extends downwardly over a pulley 130 to the inlet I2 comprising a fitting F2 wherein the fluid will now enter the cylinder 150 and act upon the end B2 of the free lift cylinder 150*a* and extend the free lift cylinder in a direction X1 through a position T2 wherein the full extension of the cylinder is achieved and the fluid being pumped into the inlet I1 at nipple N1 disposed within the body of the cylinder 151*f* allows the fluid to pass through the hollow piston rod 151*b* act upon the end B3 and the end B6 by conventional method of the piston rods 151 and 155 respectively, thus the piston rods 155*b* and 151*b* will extend once the free lift cylinder has extended to its fullest limit at T2 and the carriage stage 80 will begin to rise as best observed in relation to FIG. 9. The secondary cylinders will then extend in a direction X2 to the full extension of the piston rods 151*b* and 155*b* until such time as they have achieved their full limit which will be the full extension of the four stage carriage mechanism 40. When hydraulic fluid is drained from the system it is of course determined by the diameters W1 and W2 that the fluid will drain from the cylinders 151 and 155** initially to the extent that they are extended until such time as the free lift cylinder will retract to its nonextended position.

Figure 6:
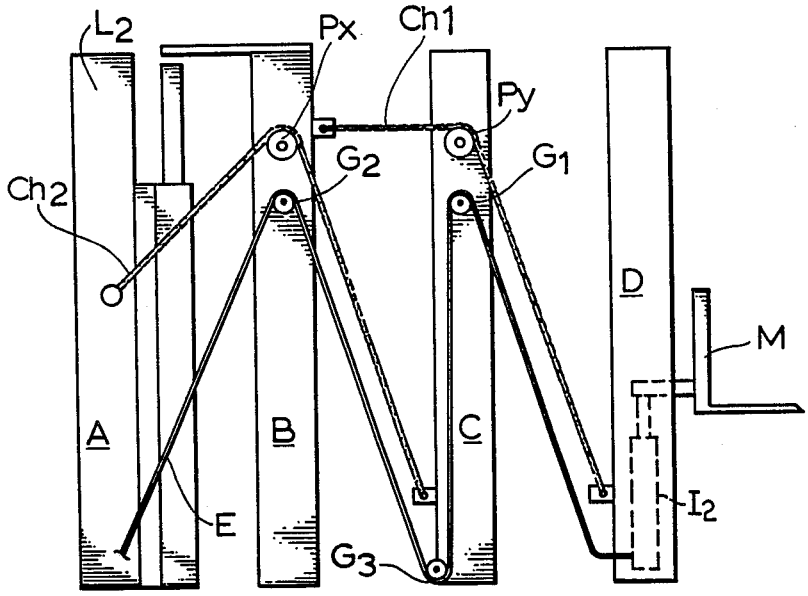
FIG. 6 PRIOR ART.
FIG. 6 is a schematic view of a four stage carriage mechanism known in the prior art.

Referring now to FIGS. 6 through 9 there is found a four stage carriage mechanism. FIG. 6 illustrates a prior art example of a four stage lift mechanism wherein a considerable amount of hosing is disposed in order to provide the free lift cylinder with the required hydraulic fluid by conventional methods. Thus, in FIG. 6 is found four stages a, b, c, and d wherein is disposed a free lift cylinder A1 and a pair of secondary cylinders L2 wherein chain portions CH2 and CH1 provide the necessary motivation to raise the stages as is known in the art. The chains extend over pulleys PX and PY and are fastened at fastening locations on stages a and c for CH2 and b and d for CH1. The free lift cylinder A1 is attached to the fork mechanism M by conventional methods.

Figure 7:
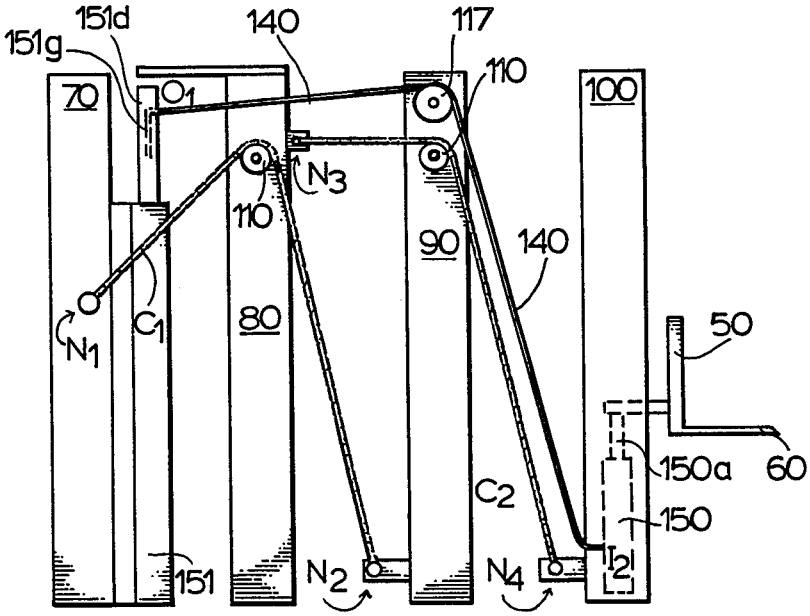
FIG. 7 is a schematic view of the four stage carriage mechanism of FIG. 1 in a preferred embodiment of the invention illustrating the starting position for the sequence of movement of said carriage.

Referring now to FIG. 7, there is disposed the four stages of the invention in a preferred embodiment thereof 70, 80, 90, and 100. The free lift cylinder 150 has attached to the piston rod **150*a* at the upper end thereof a frame member 50 from which extends the forks 60 as is well known in the art. The secondary cylinders 151 and 155 (not shown) are attached to the initial stage 70 and the frame and the next stage 80 proximate the lug 151*d*. The fluid will pass through the hollow piston 151*b* through the channel 151*g* out the outlet O1 through the hose 140 over a pulley 117 then downwardly toward the inlet I2 of the free lift cylinder 150. Thus, the secondary cylinder 151 is used to conduct fluid vertically through to the outlet O1 wherein the hose carries the fluid to the free lift cylinder therefrom. Further as the stages move the outlet O1 moves eliminating the need for any further hose lengths. The stage 80 is connected to the secondary cylinder 151 and 155 (not shown). The stage 90 is attached to the stage 70 via a chain portion C1 which is affixed at N1 to the stage 70 and at N2 to the stage 90. Further, the stage 80 is connected to the stage 100 via a chain portion C2 which is fixed to the stage 80 at N3 and to the stage 100 at N4. In the preferred embodiment there exists a ratio of movement of each stage in relation to the secondary cylinders. Stage four 100 will move in a ratio of 3:1 in relation to the cylinder by establishing the correct length of C2. Further the third stage 90 will move in a ratio of 2:1 in relation to the movement of stage 2, 80 and the secondary cylinders. These ratios are preferred and are not absolutely necessary in every alternative embodiment. Thus, when the cylinders 151 and 155 extend as is clearly visible in FIG. 9, the chain portion disposed between pulley 110 and N2 will shorten thus, causing stage 90 to lift simultaneously with stage 80 which is being lifted by the secondary cylinders 151 and 155 in a direction D1 and will cause the further movement via the chain of stage 90 in the direction D1 by a proportional amount to the movement of the chain around the pulley 110. Further, as the stage 80 is raised, the chain C2 will drive the stage 100 in a vertical direction D1. The free lift cylinder 150 will of course, begin the entire cycle as is known in the art by the movement of the forks 60 in a vertical direction D2 to the full extent of the piston rod 155** prior to the extension of the secondary cylinders.

Referring now to FIG. 8, there is described the interrelationship of the stages 70, 80, 90 and 100 wherein rollers R1, R2, R3, and R4 are disposed on each end of the free lift cylinder 150 within the channels located between the interior face of the T-sections of stages 70, 80, 90 and 100 and the adjacent face of the stage held within stages 70, 80, and 90. A member 190 has been provided to suspend roller R5 to more clearly allow the stage 100 to extend smoothly. The rollers are well known in the art and are included for reference purposes. Each of the carriage stages includes a inverted T-shaped channel having an inverted L-shape at the other end thereof with the exception of stage 100 which is a substantially I-shaped channel in cross-section. The aforementioned shapes as is well understood by a man skilled in the art are referred to cross-sectional shapes. Flanges 101, 91 and 81, extend proximate the material handling truck 10 to bound the roller at the end and prevent them from escaping. Flanges 102, 92 and 82 respectively extend at the other end thereof to retain the rollers wherein carriage member 100 provides a secondary flange 103 to further retain the roller R4 in its locating channel. The carriages then will be free to move assisted by the roller mechanisms and the shapes of the channel enabling the removement of the stages as described in relation to FIGS. 7 and 9.

Figure 5:
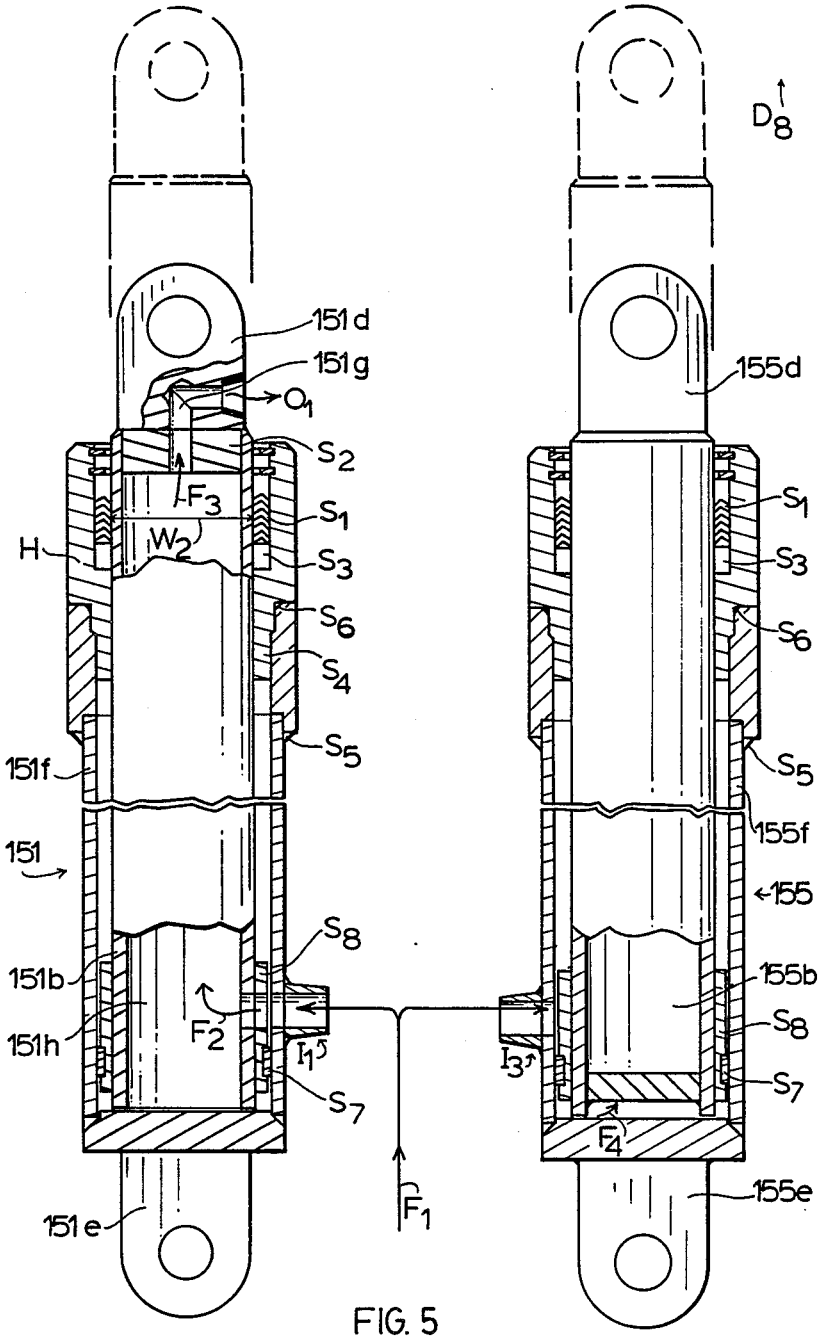
FIG. 5 is a close up sectional view of the secondary cylinders illustrated schematically in FIG. 2 in a preferred embodiment of the invention.

Referring now to FIG. 5, there is illustrated the secondary cylinders 155 and 151 each cylinder having a nipple or inlet at I1 and I3 respectively for a fluid F1, wherein the fluid will enter at I3 into the cylinder 155 by conventional methods and will once the free lift cylinder is extended its full predetermined limit extend cylinder 155 via **155*b* by a fluid port F4 which will push up the piston rod 155*b* in a direction D8. The structure of the cylinder 155 and the piston rod 155*b* is similar to the construction of the cylinder 151 and 151*b* with the exception that the hollow piston rod is not found within cylinder 155. Thus, portions described in relation to cylinder 151 are to be assumed present in cylinder 155 with respect to packing and diameter size unless otherwise stated. The only difference again being between the cylinders is the ability of cylinder 151 to act as a hydraulic fluid conduit as well as a cylinder. Thus, we find in cylinder 151 an outer hollow cylinder 151*f*, wherein is disposed a hollow piston rod 151*b* within which is disposed a hollow 151*h*, an inlet I1, which is a half inch male pipe nipple in the preferred embodiment allows the inlet of the oil to flow through the cylinder 151*f* and through the hollow piston rod 151*b* into the chamber or channel 151*h*. A wear ring S7 and a piston rod wear ring S8 is provided, to allow for passage of fluid past the piston rod at the bottom end proximate I1 and into the open end thereat once the piston rod extends sufficiently to misalign the inlet I1 with the inlet into the hollow piston rod. The head of the cylinder includes a seal portion S1 and a wearing portion S3 disposed proximate the outlet 151*g*. An O-ring S6 is disposed within the head of the cylinder to provide a seal wherein the head portion is connected via a threaded portion S6 and a welded portion S5 to the lower cylindrical portion 151*f*. The head being described by the alphabetical character H. Disposed within the hollow piston tube of a diameter W2 at one end thereof is a piston portion S2 having an opening 151*g* extending therethrough and though the lug portion 151*d* wherein the fluid extends out to opening O1. Thus, the fluid will pass through from the inlet I1 in a direction F2 out the opening 151*g* and out the opening O1, then extend down through the holes 140 to the inlet of the free lift cylinder. Once the fluid has raised the free lift cylinder to its maximum extent as illustrated in relation to FIG. 3, the fluid will then pass to moving cylinders 155 and 151 in a direction D8, wherein the piston portion S2 will transmit the fluid pressure from the fluid to the portion S2 as no more fluid will pass through 151*g* the full extent of the hydraulic pressure will bear upon the secondary cylinders and raise them to their predetermined extent as illustrated in relation to FIGS. 6 through 9**. The end of the piston rod proximate the wear rings is substantially open to allow for the entrance of fluid into the hollow piston rod once it begins to extend in the direction D8. The fluid will pass by the wear rings S7 and into the open end, thus providing a continuous column of fluid to extend the piston rod. It is of course understood that the end need not be entirely open but may have a separate inlet to allow fluid to enter the piston rod once the original inlet is no longer in alignment with I1.

In an alternative embodiment of the invention both secondary cylinders 151 and 155 are embodied with a hollow piston rod and a channel extending therethrough to provide the fluid to the free lift cylinder. It has been discovered by experimentation that such an embodiment provides for smoother and quicker motion of the free lift cylinder. However the details and construction of a second hollow cylinder would be exactly the same as described in relation to the construction of FIG. 5 in relation to cylinder 151.

Further, it is implied by the construction of the cylinder of FIG. 5 and specifically cylinder 151 that other material handling devices would further benefit from the construction of a cylinder which behaves as cylinder 151 in that it provides a passage of hydraulic fluid to a remote cylinder and thereby replaces a considerable amount of hose conventionally used to transmit the fluid from one position to another. Of course, to take advantage of the invention it must be necessary that the cylinder be used in a similar manner to that used described in the preferred embodiment.

As many changes can be made to the preferred embodiments of the invention without departing from the scope of the invention; it is intended that all matter contained herein be illustrative of the invention and not in a limiting sense.

The embodiments of the invention in which an exclusive property or privilege is claimed are as follows:

1. A hydraulic cylinder comprising a hollow tubular sleeve having inserted there within in use a hollow piston rod, said hollow sleeve having disposed therein at one end thereof an inlet for hydraulic fluid and being otherwise substantially closed at that end, said hollow cylinder having inserted therein the hollow piston rod in use, said hollow piston rod in use having disposed at the end of the piston rod proximate the closed end of the cylinder an opening allowing hydraulic fluid to pass from the inlet into the hollow piston rod, the hollow piston rod being otherwise substantially open at the end of the opening across at least a portion of the diameter of the piston rod at the end of the opening, said hollow piston rod having disposed at the end of the hollow piston rod remote the opening therein mounting means, the hollow piston rod having at the end proximate the mounting means an outlet, wherein the hollow piston rod further comprises mounting means being lug means, whereby in use hydraulic fluid passes through the inlet of the hollow sleeve into the piston rod at the end proximate the inlet to the hollow sleeve and then out of the piston rod proximate the lug means of the piston rod at the end of the piston rod remote the hydraulic oil inlet.

2. The hydraulic cylinder of claim 1 wherein the hollow cylinder is sealed at the end of the cylinder proximate the mounting means on the hollow piston rod.

3. The hydraulic cylinder of claim 1 or 2 wherein the cylinder assembly has at the end thereof proximate the mounting means sealing means to seal the piston rod against the hollow sleeve.

4. For use in a material handling truck, a hydraulic cylinder comprising a hollow tubular sleeve having inserted there within in use a hollow piston rod, said hollow sleeve having disposed therein at one end thereof an inlet for hydraulic fluid and being otherwise substantially closed at that end, said hollow cylinder having inserted therein the hollow piston rod in use, said hollow piston rod in use having disposed at the end of the piston rod proximate the closed end of the cylinder an opening allowing hydraulic fluid to pass from the inlet into the hollow piston rod, the hollow piston rod being otherwise substantially open at the end of the opening across at least a portion of the diameter of the piston rod at the end of the opening, said hollow piston rod having disposed at the end of the hollow piston rod remote the opening therein mounting means, the hollow piston rod having at the end proximate the mounting means an outlet, wherein the hollow piston rod further comprises mounting means being lug means, whereby in use hydraulic fluid passes through the inlet of the hollow sleeve into the piston rod at the end proximate the inlet to the hollow sleeve and then out of the piston rod proximate the lug means of the piston rod at the end of the piston rod remote the hydraulic oil inlet.

5. The hydraulic cylinder of claim 4 wherein the hollow cylinder is sealed at the end of the cylinder proximate the mounting means on the hollow piston rod.

6. The hydraulic cylinder of claim 4 or 5 wherein the cylinder assembly has at the end thereof proximate the mounting means sealing means to seal the piston rod against the hollow sleeve.

7. For use in a material handling truck having a hydraulic system there is provided a mast assembly comprising a first cylinder having an inlet at one end, and at least a second cylinder, said first cylinder having a first piston rod disposed therein, at least one of said at least a second cylinder having a hollow piston rod disposed therein, said first piston rod being of a greater diameter than said hollow piston rod, said hollow piston rod having two ends and having a hollow chamber extending axially through the center thereof, at least one hollow piston rod having an opening disposed at one end of the hollow piston rod proximate the inlet of said first cylinder and in communication with said hollow chamber, said at least one hollow piston rod being otherwise substantially open at the end of the opening across at least a portion of the diameter of the piston rod at the end of the opening, said hollow piston rod having mounting means disposed at the end thereof remote said opening, having proximate said end of said mounting means an opening extending therethrough from said mounting means of said piston rod at that end in communcation with said hollow chamber, said at least a second cylinder initially receiving hydraulic fluid from said hydraulic system, said hydraulic fluid passing through the hollow chamber of said hollow piston rod of said at least a second cylinder, said hydraulic fluid exiting said hollow piston rod proximate said mounting means and being conducted to said first cylinder; whereby the piston rod in said first cylinder will extend to a predetermined extent when hydraulic fluid enters therein, whereby following the extension of said first piston rod to a predetermined extent said hollow piston rod of said at least a second hydraulic cylinder will extend up to its predetermined extent.

8. For use in a fork truck having a hydraulic system there is provided a mast assembly comprising a first cylinder having an inlet at one end and at least a second cylinder, said first cylinder having a first piston rod disposed therein, at least one of said at least a second cylinder having a hollow piston rod disposed therein, said first piston rod being of a greater diameter than said hollow piston rod, said hollow piston rod having two ends and having a hollow chamber extending axially through the center thereof, at least one hollow piston rod having an opening disposed at one end of the hollow piston rod, proximate the inlet of said first cylinder and in communication with said hollow chamber, said at least one hollow piston rod being otherwise substantially open at the end of the opening across at least a portion of the diameter of the piston rod at the end of the opening, said hollow piston rod having mounting means disposed at the end thereof remote said opening, having proximate said end of said mounting means an opening extending therethrough from said mounting means of said piston rod at that end in communication with said hollow chamber, said at least a second cylinder initially receiving hydraulic fluid from said hydraulic system, said hydraulic fluid passing through the hollow chamber of said hollow piston rod of said at least a second cylinder, said hydraulic fluid exiting said hollow piston rod proximate said mounting means and being conducted to said first cylinder; whereby the piston rod in said first cylinder will extend to a predetermined extent when hydraulic fluid enters therein, whereby following the extension of said first piston rod said hollow piston rod of said at least a second hydraulic cylinder will extend up to its predetermined extent.

9. The truck of claim 7 or 8 wherein the first cylinder has a radial inlet.

10. The structure of claim 7 or 8 wherein the hollow piston rod further comprises mounting means being lug means.

11. The structure of claim 9 wherein the hollow piston rod further comprises mounting means being lug means.

12. For use in a material handling fork truck a mast assembly comprising a first cylinder for free lifting of a pair of forks of the material handling truck and at least a second cylinder used for lifting subsequent stages of said material handling fork truck; said at least a second cylinder having an inlet and an outlet one proximate each end of said cylinder, said at least a second cylinder having disposed therein a hollow piston rod extending therethrough through which hydraulic fluid passes, the hollow piston rod having a second inlet in communication with the inlet of the at least a second cylinder and an outlet, the first cylinder being of greater diameter than the at least a second cylinder and having conduit means to conduct the fluid from the outlet of the piston rod of the at least a second cylinder to the inlet of the first cylinder whereby fluid passes through the at least a second cylinder through the hollow piston rod thereof passing through the inlet of the cylinder through the second inlet of the hollow piston rod through the outlet of the hollow piston rod to said first cylinder and raises said first cylinder to a predetermined extent and subsequently causes the at least a second cylinder to extend its predetermined extent.

13. A fork truck carriage assembly comprising four stage sections, said first section being attached to a main frame of the fork truck, said second stage being attached to at least one cylinder, said at least one cylinder being further attached to said first stage, the third stage being in communication with said first stage and being linked thereto by first engaging means, having a fourth stage in communication with said second stage and linked thereto by second engagement means, said fourth stage having attached thereto a first drive cylinder extending substantially vertically and having an inlet for hydraulic fluid to allow free lift of the forks of the fork truck to the full extent of the predetermined limit of extension of the first cylinder, said first stage having attached thereto the at least one secondary cylinder extending substantially vertically to allow lifting of the second stage to the predetermined limit of the at least one secondary cylinder, the at least one secondary cylinder being of less diameter than said first cylinder, and having an inlet disposed at one end thereof, at least one of said at least one secondary cylinder including a hollow piston rod through which hydraulic fluid passes from top to bottom thereof, the hollow piston rod having a second inlet in communication with the inlet of said second cylinder and an outlet for the hydraulic fluid to pass through the hollow piston rod to the outlet thereof and transmitted therefrom by fluid conducting means to the inlet of said first drive cylinder, fluid therefore passing to the first drive cylinder until it is extended to a predetermined extend wherein the at least one secondary cylinder will extend to its predetermined level, said third stage being extended by first engagement means linking said third stage with said first stage around pulley means attached to said second stage whereby the first engagement means causes the third stage to raise in cooperation with said second stage, said fourth being extended by second engagement means attached at one end to said second stage and passing over pulley means disposed on said third stage being fastened to said fourth stage at the other end of said engagement means wherein movement of said second stage allows for the cooperative movement of said fourth stage, said hydraulic fluid conducting means being connected only from said at least one secondary cylinder to said primary cylinder whereby all the stages will extend to a maximum of the full extent allowed by the movement of the secondary cylinder in cooperative movement therefor with said first and second engagement means.

14. The fork truck carriage of claim 13 wherein the at least one secondary cylinder comprises two cylinders.

* * * * *